US012240681B2

(12) United States Patent
Fletcher

(10) Patent No.: US 12,240,681 B2
(45) Date of Patent: Mar. 4, 2025

(54) INSULATED CONTAINER AND METHOD OF ASSEMBLING AN INSULATED CONTAINER

(71) Applicant: SCA Investments Limited, London (GB)

(72) Inventor: Andrew Fletcher, London (GB)

(73) Assignee: SCA Investments Limited, London (GB)

( * ) Notice: Subject to any disclaimer, the term of this patent is extended or adjusted under 35 U.S.C. 154(b) by 0 days.

(21) Appl. No.: 17/905,944

(22) PCT Filed: Mar. 1, 2021

(86) PCT No.: PCT/GB2021/050515

§ 371 (c)(1),
(2) Date: Sep. 9, 2022

(87) PCT Pub. No.: WO2021/181067

PCT Pub. Date: Sep. 16, 2021

(65) Prior Publication Data

US 2023/0166902 A1 Jun. 1, 2023

(30) Foreign Application Priority Data

Mar. 11, 2020 (GB) ..... 2003545

(51) Int. Cl.
*B65D 81/38* (2006.01)
*B65B 5/02* (2006.01)
(Continued)

(52) U.S. Cl.
CPC ..... *B65D 81/386* (2013.01); *B65B 5/028* (2013.01); *B65B 5/06* (2013.01); *B65B 55/00* (2013.01);
(Continued)

(58) Field of Classification Search
CPC ..... B65D 81/386; B65D 5/14; B65D 5/5007; B65D 5/566; B65D 5/685; B65D 77/042;
(Continued)

(56) References Cited

U.S. PATENT DOCUMENTS 1,168,565 A * 1/1916 Rosenwald ..... B65D 5/12 229/5.5
1,665,359 A * 4/1928 Haas ..... B65D 5/14 206/521.1
(Continued)

FOREIGN PATENT DOCUMENTS

FR 2605608 A1 4/1988
FR 2936232 A1 3/2010
(Continued)

OTHER PUBLICATIONS

International Search Report and Written Opinion of International Application No. PCT/GB2021/050515, dated May 11, 2021, 12 pp.
(Continued)

*Primary Examiner* — Christopher R Demeree
(74) *Attorney, Agent, or Firm* — Shumaker & Sieffert, P.A.

(57) ABSTRACT

There is disclosed an insulated container comprising: an external housing having abase and sidewall structure extending upwardly from the base to a first height, an upper end of the sidewall structure defining an opening of the external housing; an insert having an insert base and insert sidewall structure extending upwardly from the insert base, the insert being configured to be snugly received within the external housing, and the insert sidewall structure having a second height that is less than the first height so as to define a shoulder portion; and a thermally insulating lid having an upper surface and a lower surface, the lid being configured to be received through the opening of the external housing and positioned with edge parts of the lower surface of the lid
(Continued)

resting on the shoulder portion defined by the insert sidewall structure; wherein the sidewall structure of the external housing is provided with at least one slit positioned above the upper surface of the lid to allow a portion of the sidewall structure of the external housing above the slit to be moveable to an inverted position so as to engage the upper surface of the lid and to hold the lid in position.

24 Claims, 7 Drawing Sheets

(51) Int. Cl.

| | |
|---|---|
| ***B65B 5/06*** | (2006.01) |
| ***B65B 55/00*** | (2006.01) |
| ***B65D 5/14*** | (2006.01) |
| ***B65D 5/50*** | (2006.01) |
| ***B65D 5/56*** | (2006.01) |
| ***B65D 5/68*** | (2006.01) |
| ***B65D 77/04*** | (2006.01) |

(52) U.S. Cl.
CPC ..... *B65D 5/14* (2013.01); *B65D 5/5007* (2013.01); *B65D 5/566* (2013.01); *B65D 5/685* (2013.01); *B65D 77/042* (2013.01); *B65D 81/3825* (2013.01)

(58) Field of Classification Search
CPC ..... B65D 81/3825; B65D 5/5045; B65D 5/0245; B31B 2120/40
USPC ..... 229/103.11, 122.31, 120.32, 117.27, 229/120.15, 161, 194, 915; 206/418, 434, 206/504, 521, 594
See application file for complete search history.

(56) References Cited

U.S. PATENT DOCUMENTS

| | | | | |
|---|---|---|---|---|
| 2,692,077 | A * | 10/1954 | Kuhlman | B65D 5/5007 206/521 |
| 5,730,289 | A * | 3/1998 | Cappels | B65D 5/5045 229/89 |
| 8,523,048 | B1 * | 9/2013 | Spiegelman | B65D 5/48014 229/104 |
| 10,556,716 | B2 * | 2/2020 | Ramos | B65D 5/3614 |
| 10,894,646 | B2 * | 1/2021 | Simpkins | B65D 85/20 |
| 11,111,051 | B2 * | 9/2021 | Hessburg | B65D 5/5035 |
| 11,884,461 | B2 * | 1/2024 | Yen | B65D 5/06 |
| 2017/0327298 | A1 | 11/2017 | Morasse et al. | |
| 2021/0061542 | A1 * | 3/2021 | Aksan | B65D 81/3862 |

FOREIGN PATENT DOCUMENTS

| | | | |
|---|---|---|---|
| JP | H0667378 | U | 9/1994 |
| JP | H0742745 | U | 8/1995 |
| JP | 2001301750 | A | 10/2001 |
| WO | 2018157978 | A1 | 9/2018 |

OTHER PUBLICATIONS

Search Report from counterpart GB Application No. 2003545.7, mailed Apr. 1, 2020, 5 pp.

* cited by examiner

INSULATED CONTAINER AND METHOD OF ASSEMBLING AN INSULATED CONTAINER

This application is a national stage application under 35 U.S.C. § 371 of PCT Application No. PCT/GB2021/050515, filed 1 Mar. 2021, which claims the benefit of Great Britain Application No. 2003545.7, filed 11 Mar. 2020. The entire contents of each of PCT/GB2021/050515 and Great Britain Application No. 2003545.7 are incorporated herein by reference in their respective entireties.

This invention relates to packaging for the delivery of goods.

BACKGROUND

To keep food fresh, it has to be kept in a controlled chilled environment. This is achieved by placing the chilled items in an insulated compartment with a predetermined quantity of cooling agents such as ice packs or frozen gel packs to ensure the food is kept within a safe temperature range.

Previous solutions to keeping food chilled include utilising plastic bags with a woollen sheet of lagging that is closed by hand with a sticky strip. The disadvantages of this solution include that it is difficult to place products in a semi-closed bag when travelling on a production line. This can slow the production line, it is difficult and time consuming to close the bags, and these bags are not fully recyclable. Other alternatives that have been considered for keeping food chilled include using plastic bubble wrap or a woollen sheet to line a paper bag, however these alternatives have similar disadvantages.

Cardboard insulators can be used by filling the whole box with an insulating cardboard structure. Ranpak® provide thermal-insulating paper-based packaging that can be inserted into a box, and ClimaCell® by Temperpack® is a thermal-insulating liner made from plant-based and paper-based materials that can be used to line boxes. These solutions require the whole box to be filled with the cardboard insulator and neither of these products can be used to send a small insulator in a large box as this would move in transit. Moreover if the lid closing the insulator is able to move then any food stored inside the insulator will no longer be safe.

WO2018/157978 discloses an insulating transport/storage container for transporting/storing temperature sensitive materials, the container comprising: a generally tubular wall element defining a load volume between first and second apertures at either end thereof, the tubular wall element having an axis; first and second closures operable to close first and second apertures; and fastening means operable to secure said first and second closures; wherein the tubular wall element comprises multiple-layers of single-sided corrugated sheet, with the layers coupled together; and wherein upon securement by way of the fastening means, the closures are brought together with respect to the tubular wall element at the ends thereof about mutually contacting areas.

The assembly of such containers cannot be performed on an automated assembly line using existing machinery in box making lines and is therefore labour intensive. Furthermore, such containers cannot easily be stored in a flatpack state to be transported to packing facilities.

BRIEF SUMMARY OF THE DISCLOSURE

Viewed from a first aspect, there is provided an insulated container comprising: an external housing having a base and sidewall structure extending upwardly from the base to a first height, an upper end of the sidewall structure defining an opening of the external housing; an insert having an insert base and insert sidewall structure extending upwardly from the insert base, the insert being configured to be snugly received within the external housing, and the insert sidewall structure having a second height that is less than the first height so as to define a shoulder portion; and a thermally insulating lid having an upper surface and a lower surface, the lid being configured to be received through the opening of the external housing and positioned with edge parts of the lower surface of the lid resting on the shoulder portion defined by the insert sidewall structure; wherein the sidewall structure of the external housing is provided with at least one slit positioned above the upper surface of the lid to allow a portion of the sidewall structure of the external housing above the slit to be moveable to an inverted position so as to engage the upper surface of the lid and to hold the lid in position.

The insert provides additional insulation and the snug fit within the external housing helps to reduce relative movement of the insert in the external housing. Providing slits in the sidewall structure allows the sidewall structure to be used to lock the lid in position when the portion of the sidewall is inverted. Locking the lid helps to reduce relative movement of the lid during transportation and/or delivery of the container and this helps to maintain the insulating properties of the container so that items stored in the insert are not exposed to ambient conditions.

The at least one slit may be substantially parallel to the shoulder portion and/or the upper surface of the lid. If this slit is aligned with the upper surface of the lid and the lid is secured against the shoulder portion then the lid can be effectively secured in place when the portion of the sidewall structure is moved to the inverted position.

The base of the external housing may have a polygonal shape. The sidewall structure of the external housing may include at least three walls and at least three edges, each edge being defined between two adjacent walls. In some embodiments, there is provided a single slit formed across a portion of two adjacent walls intersecting at one of the at least three edges. In some embodiments, there are provided at least two slits, wherein each slit is formed across a portion of two adjacent walls intersecting with one of the at least three edges. In some embodiments, there is provided a slit at each edge of the sidewall, each slit being formed across a portion of two adjacent walls intersecting with one of the at least three edges. Each slit may be positioned near the opening so that a section of the external housing above each slit is moveable to the inverted position.

In one particular embodiment, the base of the external housing may have a square or rectangular shape, wherein the sidewall structure includes four walls and four edges. The sidewall structure includes one, two, three or four slits, the slits being positioned to intersect one, two, three or four of the four edges respectively. In one embodiment, there are provided two slits, formed in opposite edges of the sidewall structure. In another embodiment, there are provided four slits, one slit formed in each edge of the sidewall structure.

Polygonal shapes, in particular square or rectangular shapes, are simple to manufacture using existing machinery in packaging lines. Furthermore, providing the slits across an edge allows a portion of that edge to be inverted to contact the upper surface of the lid. Having at least two points of contact with the upper surface of the lid helps prevent the lid from becoming dislodged during transportation and/or delivery.

The sidewall structure of the external housing may include at least three walls and at least three edges, each edge being defined between two adjacent walls. In one embodiment, there is provided a single pair of slits formed across a portion of two adjacent walls intersecting at one of the at least three edges. The slits of the single pair of slits are coextensive with each other, and in some embodiments may be substantially parallel. In another embodiment, there are provided at least two pairs of slits, wherein each of the at least two pairs of slits are formed across a portion of two adjacent walls intersecting with one of the at least three edges. In some embodiments, there is provided a pair of slits at each edge of the sidewall, each pair of slits being formed across a portion of two adjacent walls intersecting with one of the at least three edges. The pairs of slits each have a first, upper slit positioned directly above a second, lower slit so that a section of the external housing between the first slit and the second slit is moveable to the inverted position. In these embodiments, it is possible to locate the pairs of slits at any point along an edge of the external housing between the top and the bottom and thus allow the lid to be secured at positions other than adjacent to the opening of the external housing. In some embodiments, the lid may be secured at a height between the top and the bottom of the external housing. This may provide a thermally insulated volume below the lid, and an ambient temperature volume above the lid. The thermally insulated volume may be used to store chilled items, and the ambient temperature volume may be used to store items that do not require chilling.

In one particular embodiment, the base of the external housing may have a square or rectangular shape, wherein the sidewall structure includes four walls and four edges. The sidewall structure includes one, two, three or four pairs of slits, the pairs of slits being positioned to intersect one, two, three or four of the four edges respectively. In one embodiment, there are provided two pairs of slits, formed in opposite edges of the sidewall structure. In another embodiment, there are provided four pairs of slits, one pair of slits formed in each edge of the sidewall structure.

In some embodiments, particularly those embodiments in which the base of the external housing has a square or rectangular shape, the external housing may itself be placed or secured within a second container having a larger footprint than the external housing. For example, the second container may have a depth substantially the same as the external housing, but a greater width. The height of the second container may be substantially the same as, or in some embodiments a height greater than, the external housing. This allows an ambient temperature volume to be defined in the second container, adjacent to the external housing of the insulated container, for storage of items that do not need to be kept chilled.

The lid may include an insulating material between the upper and lower surfaces. The insulating material may have a honeycomb structure. The lid will seal the insert, insulating the items stored within it. A honeycomb structure in the context of the present disclosure may be considered to be a structure consisting of an array of hollow tubular or cellular elements. The hollow tubular or cellular elements may have a hexagonal, square, triangular, or other polygonal cross-section. The hollow tubular or cellular elements may be formed from one or more sheets of material. The one or more sheets of material may be made of any appropriate material, for example paper or cardboard. Honeycomb structures provide insulating space between the upper and lower surfaces and reduce the use of material therefore reducing the weight and cost of the container.

The insulated container may comprise a second insert, wherein the second insert comprises a second insert sidewall structure, the second insert being configured to be snugly received within the sidewall structure of the insert. A second insert provides additional insulation when required. This may be useful when delivering cold items on warmer days or in warmer climates. Additional nested inserts of similar configuration may also be provided.

The external housing, the insert or inserts and/or the lid may be formed from cardboard. The cardboard may be double-wall corrugated cardboard. Using cardboard for single-use applications such as delivery services is preferred as it is more easily recyclable than plastic or other materials. Double-wall corrugated cardboard is known to have good insulation properties. In some embodiments, one or more of the external housing, the insert or inserts and/or the lid may be made from polymer or composite materials, or from expanded or foamed materials. For example, the lid and/or the insert may be made from or incorporate expanded polystyrene, which has excellent thermal insulation properties.

The base of the external housing may be a folded flap base secured with an adhesive, adhesive tape, staples or any other appropriate securing means. This arrangement provides structural support to the container so that heavy loads can be transported and/or delivered.

The external housing may further comprise a space within the opening and above the lid for placing items that do not require thermal insulation. Items can therefore be separated and transported and/or delivered in the same packaging.

Viewed from a second aspect, there is provided a method of assembling an insulated container comprising the steps of:

- providing an external housing having a base and sidewall structure extending upwardly from the base to a first height, wherein an upper end of the sidewall structure defines an opening of the external housing, and wherein the sidewall structure is provided with at least one slit at a second height that is less than the first height;
- providing an insert having an insert base and an insert sidewall structure extending from the insert base, the insert sidewall structure having a third height that is less than the second height;
- folding the insert sidewall structure with respect to the base so that the shape of the insert corresponds to the shape of the external housing;
- pressing the insert through the opening of the external housing so that the insert sidewall structure is snugly received in external housing, wherein when the insert is received in the external housing the insert sidewall structure defines a shoulder portion;
- positioning a thermally insulated lid through the opening of the external housing, the lid having an upper surface and a lower surface, wherein edge parts of the lower surface of the lid portion rest on the shoulder portion defined by the insert sidewall structure and the upper surface is positioned below the at least one slit when the lid is in place; and
- moving a portion of the sidewall structure above the slit to an inverted position to engage the upper surface of the lid and to hold the lid in position.

The insert provides additional insulation and the snug fit within the external housing helps to reduce relative movement of the insert in the external housing. Providing slits in the sidewall structure allows the sidewall structure to be used to lock the lid in position when the portion of the sidewall is inverted. Locking the lid helps to reduce relative movement of the lid during transportation and/or delivery of the container and this helps to maintain the insulating properties of the container so that items stored in the insert are not exposed to ambient conditions.

The base of the external housing may have a square or rectangular shape, and the insert may be cross-shaped prior to folding the insert. Prior to assembly, the external housing and insert can be flat packed and is economical to transport to assembly sites. The assembly of this arrangement can be automated using existing machinery in packaging lines.

The method may include the step of adding cooling agents and/or items to be thermally insulated in the insert prior to placing the lid into the opening of the external housing. Embodiments of the present disclosure provide thermal insulation and can keep items stored within the insert cool for longer periods of time. Examples of cooling agents include ice packs, ice blocks, frozen gel packs, dry ice or other chemical cooling means. Therefore, items requiring thermal insulation during transportation and/or delivery can be added to the insert along with cooling agents to keep the items within predetermined temperature range for a predetermined period of time.

Following the step of pressing the insert into the opening of the external housing, a second insert having a second insert sidewall structure may be pressed into the first insert so that the second insert sidewall structure is snugly received in the sidewall structure of the insert. A second insert can provide additional insulation when required. This may be needed when delivering cold items on warmer days or in warmer climates.

BRIEF DESCRIPTION OF THE DRAWINGS

Embodiments of the invention are further described hereinafter with reference to the accompanying drawings, in which.

DETAILED DESCRIPTION

Figure 1:
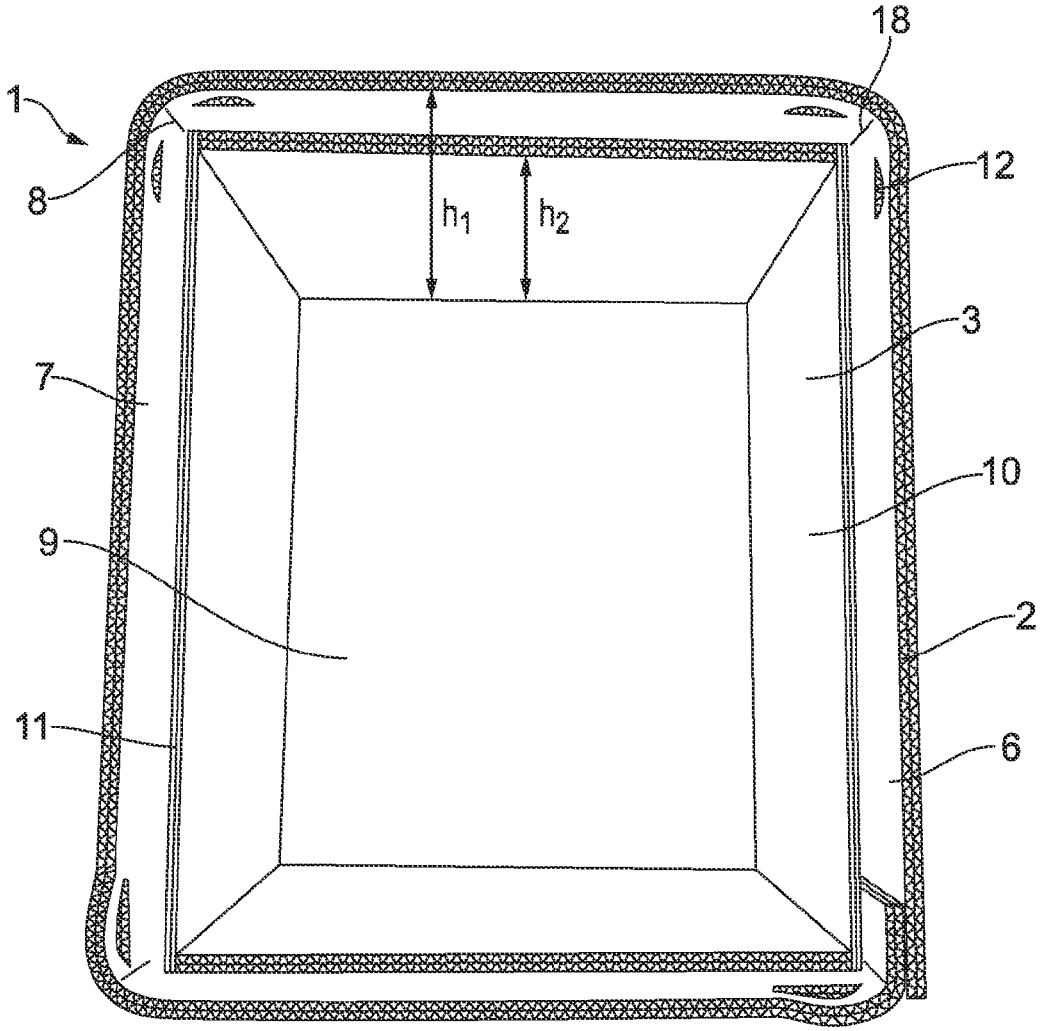
FIG. 1 is a perspective view of the insulated container without the lid.

Referring to FIG. 1, there is shown a perspective view of the insulated container 1. The insulated container comprises an external housing 2 having a square or rectangular-shaped base 5 (see FIG. 3) and four walls 6 extending upwardly from the base to a first height ($h_1$). The base 5 may be a folding flap base secured with an adhesive such as tape or glue, or possibly with staples. The upper ends of the four walls 6 define an opening 7 of the external housing 2. An insert 3 is snugly received inside the external housing 2. The insert 3 comprises an insert base 9 and four insert walls 10 extending upwardly from the insert base 9 to a second height ($h_2$). The height ($h_2$) of the insert walls 10 is less than the height ($h_1$) of the external housing walls 6 so that upper edges of the insert walls 10 define a shoulder portion 11.

The walls 6 of the external housing 2 have four slits 12, each slit 12 is positioned across an edge 8 between two adjacent walls 6. Each slit 12 is parallel to the shoulder portion. The slits 12 are positioned above the height ($h_2$) of the insert walls 10 so that there is space to receive an insulating lid 4 (not shown in FIG. 1) between the shoulder portion 11 and the slits 12.

The external housing 2 and the insert 3 may be made using any stiffened sheet of material, such as cardboard, polypropylene, or other extruded sheet formed from polymer or composite materials. The external housing 2 and the insert 3 may be formed from sheets having a double-wall corrugated structure.

Figure 2:
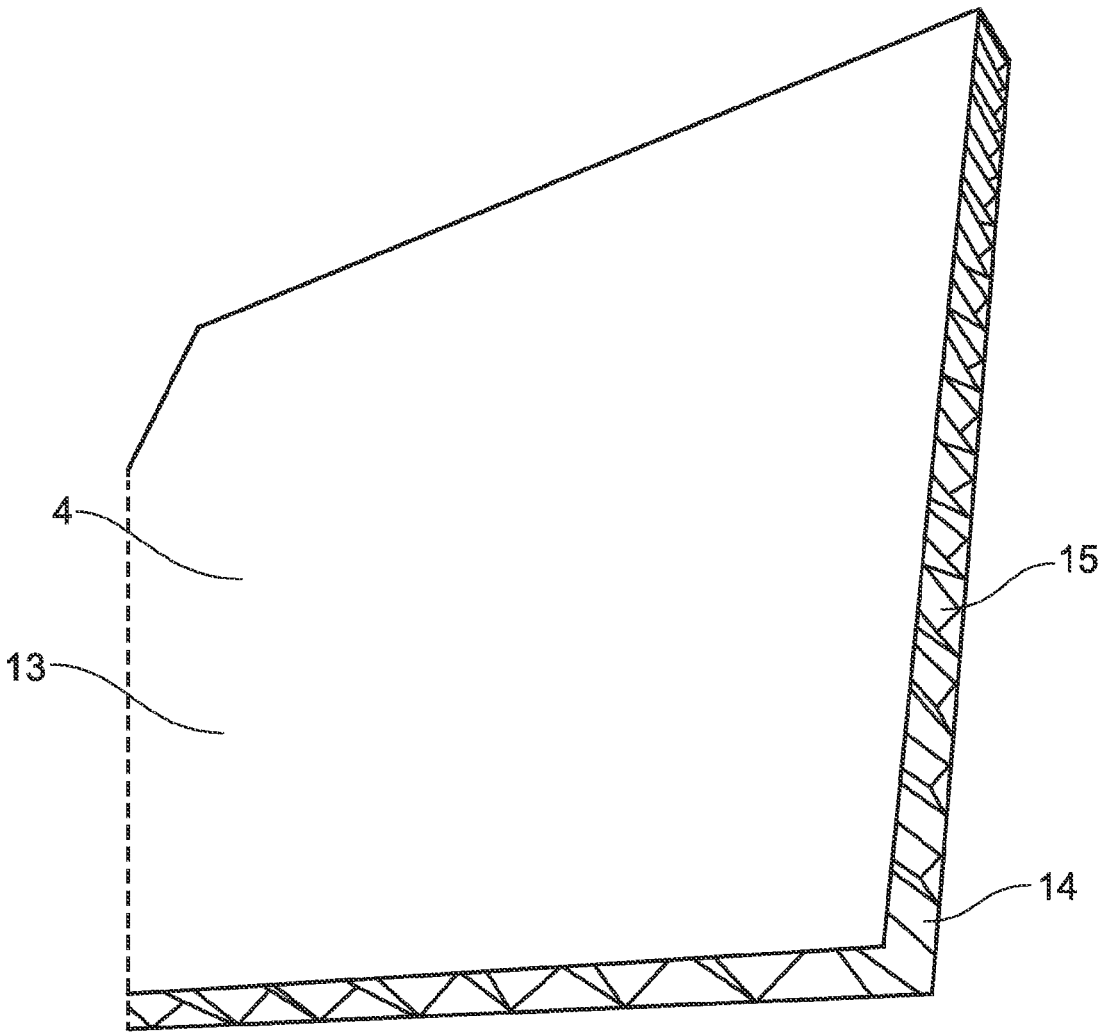
FIG. 2 is a perspective view of the lid.

Referring to FIG. 2, there is shown a perspective view of the insulating lid 4. The lid has an upper surface 13 and a lower surface 14 that sandwich an insulating material. The insulating material shown is arranged in a honeycomb structure 15 and is attached to the upper and lower surfaces 13, 14 using an adhesive such as glue. One or more layers of honeycomb structure may be used, separated by sheets of material. The honeycomb structure 15 may be formed from a continuous sheet of material or may be formed from interconnected sheets.

The insulating material may alternatively be arranged in a single or multi-layered corrugated structure or as a sheet positioned between the upper and lower surfaces 13, 14 and attached using an adhesive such as glue. The insulating material may include cardboard, polypropylene, polystyrene foam, polyethylene foam, wool, cellulose, cotton, other natural or synthetic fibres, or any combination thereof. Cardboard, polypropylene, or another stiffened material may be used to form the honeycomb or corrugated structures. The insulating material may be made from recycled materials. The upper and lower surfaces 13, 14 of the lid may be any stiffened sheet of material, such as cardboard, polyethylene or other extruded plastic sheet.

Figure 3:
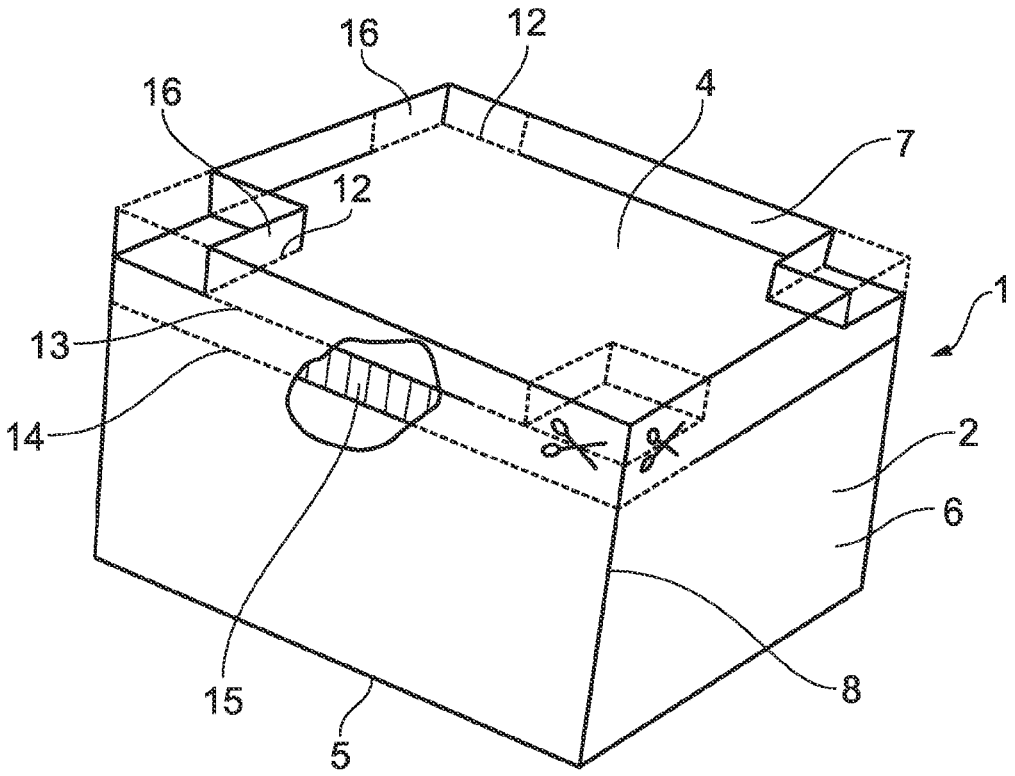
FIG. 3 is a perspective view of the insulated container with the lid in position.

Referring to FIG. 3, there is shown a perspective view of the insulated container 1 with the lid 4 in position. The lid 4 is received through the opening 7 of the external housing 2. The lid 4 is positioned with edge parts of the lower surface 14 resting on the shoulder portion 11 defined by the insert walls 10. The portion of the external housing 16 above the slit 12 has been inverted by pushing this portion of the external housing 16 towards the centre of the insulated container 1 so that it engages the upper surface 13 of the lid 4.

In one embodiment, the lid 4 has a thickness between approximately 5 to 50 mm, preferably between approximately 10 to 25 mm and more preferably between approximately 15 to 20 mm. The length of each slit 12 is between approximately 5 to 70 mm, preferably between approximately 20 to 50 mm and more preferably between approximately 30 to 40 mm. The distance between the slit 12 and the uppermost edge of the external housing wall 6 is between approximately 5 to 40 mm and more preferably between approximately 15 to 25 mm. The distance between the shoulder portion 11 and the uppermost edge of the external housing wall 6 is between approximately 10 to 75 mm, preferably between 20 to 50 mm, and more preferably between 30 to 40 mm. The height of the external housing is between approximately 100 mm to 1000 mm and more preferably between 150 mm to 450 mm. The depth of the external housing is approximately between 100 mm to 800 mm and more preferably between 200 mm and 300 mm. The width of the external housing is approximately 100 mm to 800 mm and more preferably between 250 and 350 mm.

Figure 4:
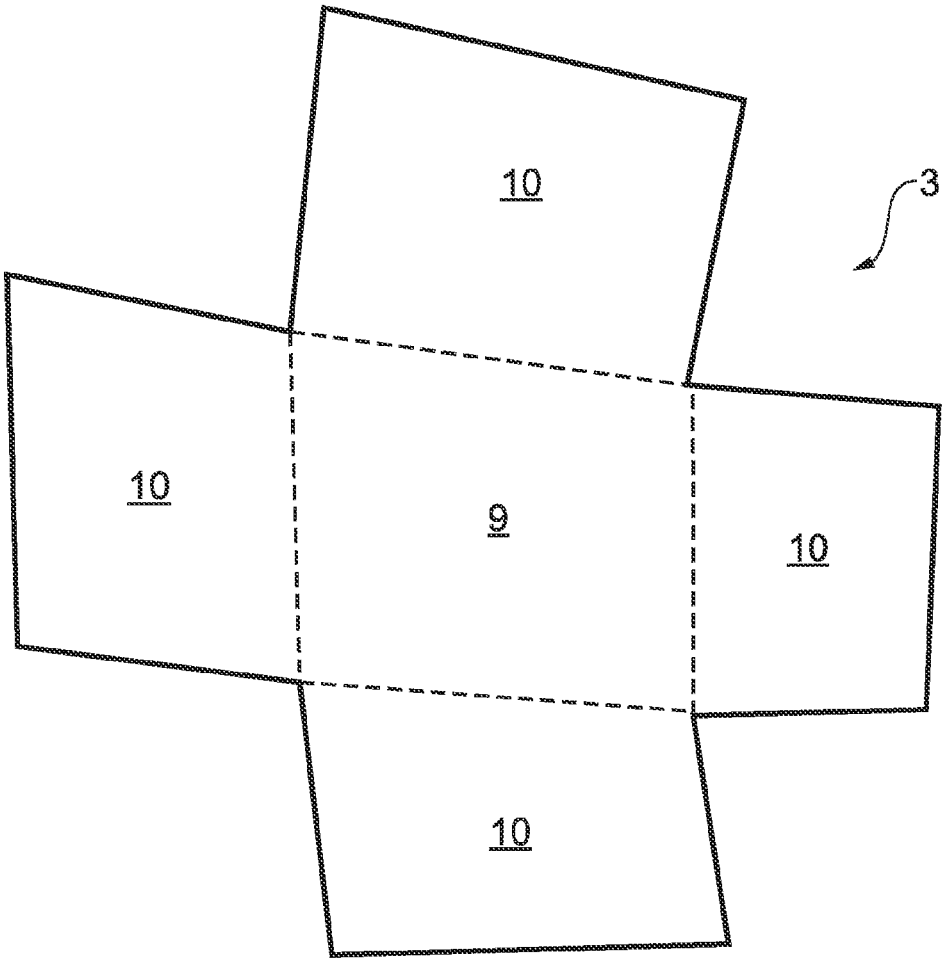
FIG. 4 is a top view of the insert in a flatpack configuration.

Referring to FIG. 4, there is shown a top view of the insert 3 in a flatpack configuration. The insert 3 is cross-shaped, each of the four walls 10 extending from the insert base 9. The insert 3 can be transported to an assembly site in the flatpack position to help minimise the space needed to transport the inserts. At the assembly site, the insert walls 10 can be folded up using existing packaging machinery. In the folded configuration, the insert 3 can then be pressed in the external housing 2 (not shown).

Figure 5:
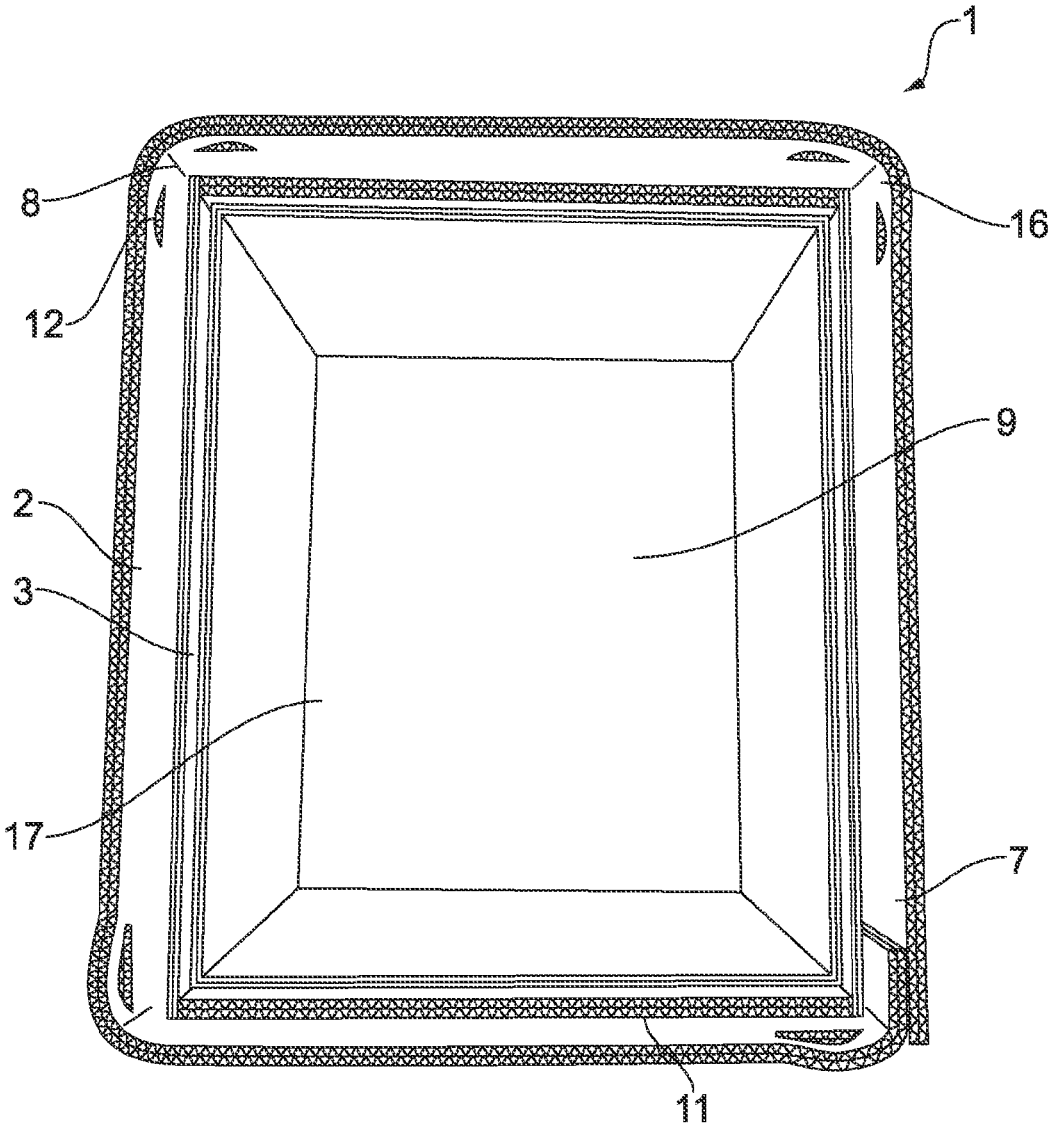
FIG. 5 is a perspective view of the insulated container including the second insert without the lid.

Referring to FIG. 5, there is shown a perspective view of the insulated container 1 including the second insert 17 without the lid. The second insert 17 comprises for four walls which correspond to the shape of the insert walls 10 and is snugly received within the insert 3. The second insert 17 may also include a base. The second insert can be used to provide additional insulation during warmer months or for warmer climates. Additional nested inserts of similar configuration may also be provided. To assemble the insulated container 1, the external housing 2 is assembled and the folding base 5 secured with an adhesive or adhesive tape or staples or the like. The insert 3 is folded and press fit through the opening 7 into the external housing 2. Additional inserts 17 may be added by folding them and pressing them into the outermost insert 3. The insert 3 is then filled with chilled items such as food requiring refrigeration, and cooling agents such as ice packs, ice blocks, frozen gel packs, dry ice or other chemical cooling means are added. The lid 4 is then placed in the opening 7 to rest on the shoulder portion 11. The portion of the external housing 16 above the slit 12 is then pressed to invert the edge 8 between two adjacent walls 6, the inverted edge securing the lid 4 in position.

The insulated container 1 can then be placed in a second, outer container 18. Additional items such as pantry food that does not require refrigeration can then be placed around the insulated container 1. Once the second, outer container 18 is filled, a folding flap lid of the second, outer container 18 may be closed and may be sealed with an adhesive or adhesive tape or staples.

Figure 6A:
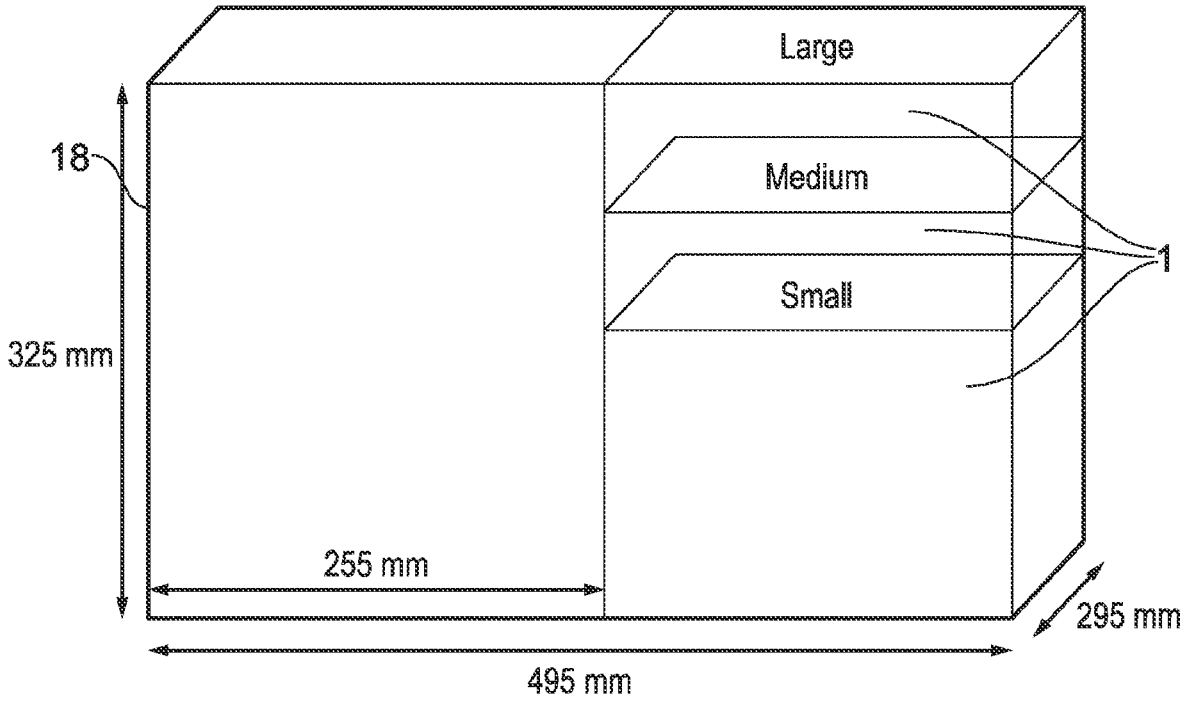
FIG. 6*a* is a perspective view of the insulated container inside a second container.
Figure 6B:
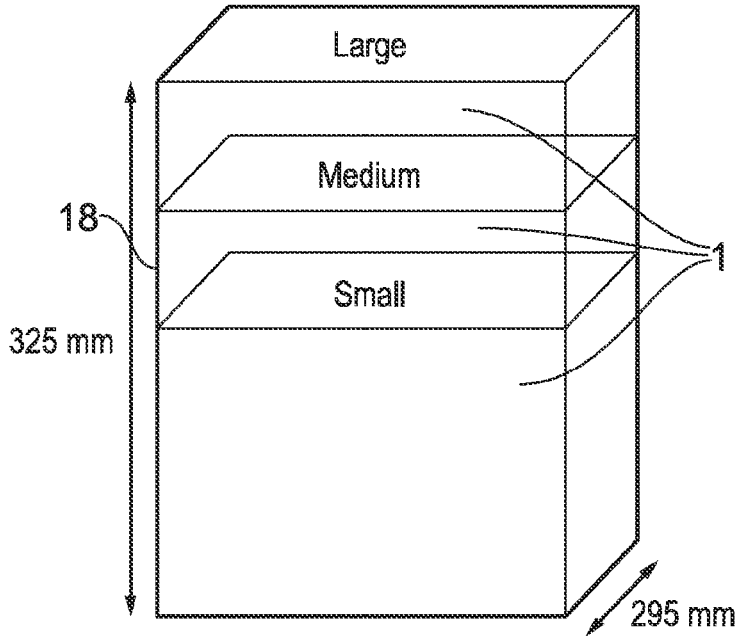
FIG. 6*b* is a perspective view of the insulated container inside a different second container.

Referring to FIGS. 6*a* and 6*b*, there are shown embodiments of the second, outer container 18. The insulated container 1 is placed in a second, outer container 18 for transporting, delivering or storing the insulated container 1 and other items. Items that can be transported or delivered at ambient temperatures are stored in the second container 18 in the space around the insulated container 1. Items that do not require insulation can therefore be separated from items requiring insulation and transported and/or delivered in the same packaging.

Referring to FIG. 6*a*, there is shown a perspective view of a first embodiment of the second container 18. The insulated container 1 is dimensioned to have approximately the same depth as the second container 18 and approximately half the width of the second container 18 such that the insulated container 1 can be received inside the second container 18. This insulated container 1 may be placed in one half of the second container 18. The height of the insulated container 1 may be any height less than or equal to the height of the second container 18. In embodiments where the insulated container 1 is of a height substantially equal to that of the second container 18, it may be preferable for the insulated container 1 to be at least 5 mm shorter in height than the second container 18 for ease of closing lid flaps of the second container 18. Items that can be stored and/or transported at ambient temperatures str stored in the space beside the insulated container 1, or above the insulated container 1 if an insulated container 1 is selected with a height that is less than the height of the second container 18.

Referring to FIG. 6*b*, there is shown a perspective view of a second embodiment of the second container 18. The insulated container 1 is dimensioned to have approximately the same depth and width of the second container 18 such that it can be received inside the second container 18. The height of the insulated container 1 may be any height less than or equal to the height of the second container 18. In embodiments where the insulated container 1 is of a height substantially equal to that of the second container 18, it may be preferable for the insulated container 1 to be at least 5 mm shorter in height than the second container 18 for ease of closing lid flaps of the second container 18. Items that can be stored and/or transported at ambient temperatures are stored in the second container 18 in the space above the insulated container 1 if an insulated container 1 is selected with a height that is less than the height of the second container 18.

In alternate embodiments, the base of the external housing be any shape. For example, the base may be circular, elliptical, triangular or trapezoidal. The shape of the insert base will correspond to the shape of the base of the external housing. In embodiments where the base and the walls are rounded, for example if the base has a circular or elliptical shape, then a minimum of one slit is needed in the wall in a direction parallel to the upper surface of the lid and the shoulder portion. The portion above the slit can be inverted to hold the lid in position. Additional slits can be added to help improve the retention of the lid. In embodiments where the base has a polygonal shape with a corresponding number of walls to the edges of the base, a minimum of two slits is required across edges defined by two adjacent walls. The slits are formed in a direction parallel to the upper surface of the lid and the shoulder portion. This slits may be formed in substantially opposing edges so that when the portion of the external housing above the slits is inverted, the lid is held securely in position. Additional slits can be added at other edges defined by two adjacent walls to help improve the retention of the lid.

In alternate embodiments, a pair of parallel slits having a first and second slit are formed in the external housing across an edge defined by two adjacent walls, the second slit is positioned directly above the first slit. The portion of the external housing between the two slits can be inverted to hold the lid securely in position. The remainder of the area within the external housing above the lid can then be used to store items that do not require insulation and can be stored at ambient temperatures. The external housing may include a folding flap lid to that can be secured by an adhesive or adhesive tape or staples to seal the external housing.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

LIST OF PARTS

For ease of reference, the parts labelled in the accompanying drawings are as follows:

Insulated container—1
External housing—2
Insert—3
Lid—4
Base (external housing)—5
Walls (external housing)—6
Height of external housing walls—h1
Opening of external housing—7
Edge (between two adjacent external housing walls)—8
Insert base—9
Insert walls—10
Height of insert walls—h2
Shoulder portion—11
Slit—12
Upper surface (lid)—13
Lower surface (lid)—14
Honeycomb structure—15
Portion of the external housing above the slit—16
Second insert—17
Second container—18

The invention claimed is:

1. An insulated container comprising:

an external housing having a base and sidewall structure extending upwardly from the base to a first height, an upper end of the sidewall structure defining an opening of the external housing;

an insert having an insert base and insert sidewall structure extending upwardly from the insert base, the insert being configured to be snugly received within the external housing, and the insert sidewall structure having a second height that is less than the first height so as to define a shoulder portion; and a thermally insulating lid separate from the insert having an upper surface and a lower surface, the lid being configured to be received through the opening of the external housing and positioned with edge parts of the lower surface of the lid resting on the shoulder portion defined by the insert sidewall structure;

wherein the sidewall structure of the external housing is provided with at least one slit positioned above the upper surface of the lid to allow a portion of the sidewall structure of the external housing above the slit to be moveable to an inverted position so as to engage the upper surface of the lid and to hold the lid in position.

2. The insulated container as claimed in claim 1, wherein the at least one slit is substantially parallel to the shoulder portion and/or the upper surface of the lid.

3. The insulated container as claimed in claim 1, wherein the base of the external housing has a round or oval shape.

4. The insulated container as claimed in claim 1, wherein the base of the external housing has a polygonal shape.

5. The insulated container as claimed in claim 4, wherein the sidewall structure of the external housing includes:

at least three walls and at least three edges, each edge being defined between two adjacent walls; and at least one slit formed across a portion of two adjacent walls intersecting at one of the at least three edges, and wherein the at least one slit is positioned near the opening so that a section of the external housing above each slit is moveable to the inverted position.

6. The insulated container as claimed in claim 5, wherein the base of the external housing has a square or rectangular shape, and wherein the sidewall structure includes four walls and four edges.

7. The insulated container as claimed in claim 6, wherein the sidewall structure includes two slits, the slits being formed in opposite edges of the sidewall structure.

8. The insulated container as claimed in claim 6, wherein the sidewall structure includes four slits, one slit being formed in each of the edges of the sidewall structure.

9. The insulated container as claimed in claim 4, wherein the sidewall structure of the external housing includes:

at least three walls and at least three edges, each edge being defined between two adjacent walls; and at least one pair of coextensive slits formed across a portion of two adjacent walls intersecting at one of the at least three edges, and wherein the at least one pair of coextensive slits comprises a first, upper slit positioned directly above a second, lower slit so that a section of the external housing between the first slit and the second slit is moveable to the inverted position.

10. The insulated container as claimed in claim 9, wherein the base of the external housing has a square or rectangular shape, and wherein the sidewall structure includes four walls and four edges.

11. The insulated container as claimed in claim 10, wherein the sidewall structure includes two pairs of slits, the pairs of slits being formed in opposite edges of the sidewall structure.

12. The insulated container as claimed in claim 10, wherein the sidewall structure includes four pairs of slits, one pair of slits being formed in each of the edges of the sidewall structure.

13. The insulated container as claimed in claim 1, wherein the lid includes an insulating material between the upper and lower surfaces.

14. The insulated container as claimed in claim 13, wherein the insulating material has a honeycomb structure.

15. The insulated container as claimed in claim 1, wherein the insert comprises a first insert, the insulated container further comprising a second insert, wherein the second insert comprises a second insert sidewall structure, the second insert being configured to be snugly received within the sidewall structure of the first insert.

16. The insulated container as claimed in claim 15, wherein the second insert further comprises a second insert base, and wherein the second insert sidewall structure extends upwardly from the second insert base.

17. The insulated container as claimed in claim 1, wherein the external housing, the insert(s) and/or the lid are formed from cardboard.

18. The insulated container as claimed in claim 17, wherein the cardboard is double-wall corrugated cardboard.

19. The insulated container as claimed in claim 1, wherein the external housing further comprises a space within the opening and above the lid for containing items that do not require thermal insulation.

20. The insulated container as claimed in claim 1, in combination with a second container having a larger footprint and volume than the insulated container, the insulated container located inside the second container so as to define an ambient temperature volume between the insulated container and the second container for containing items that do not require thermal insulation.

21. A method of assembling an insulated container comprising the steps of:

providing an external housing having a base and sidewall structure extending upwardly from the base to a first height, wherein an upper end of the sidewall structure defines an opening of the external housing, and wherein the sidewall structure is provided with at least one slit at a second height that is less than the first height;

providing an insert having an insert base and an insert sidewall structure extending from the insert base, the insert sidewall structure having a third height that is less than the second height;

folding the insert sidewall structure with respect to the base so that the shape of the insert corresponds to the shape of the external housing;

pressing the insert through the opening of the external housing so that the insert sidewall structure is snugly received in external housing, wherein when the insert is received in the external housing the insert sidewall structure defines a shoulder portion;

positioning a thermally insulated lid through the opening of the external housing, the lid having an upper surface and a lower surface, wherein edge parts of the lower surface of the lid portion rest on the shoulder portion defined by the insert sidewall structure and the upper surface is positioned below the at least one slit when the lid is in place; and moving a portion of the sidewall structure above the slit to an inverted position to engage the upper surface of the lid and to hold the lid in position.

22. The method according to claim 21, wherein the base of the external housing has a square or rectangular shape, and the insert is cross-shaped prior to folding the insert.

23. The method according to claim 21, comprising the step of adding cooling agents and/or items to be thermally insulated in the insert prior to placing the lid into the opening of the external housing.

24. The method according to claim 21, wherein the insert comprises a first insert, the method further comprising: following the step of pressing the first insert through the opening of the external housing, pressing a second insert having a second insert sidewall structure into the first insert so that the second insert sidewall structure is snugly received in the insert sidewall structure of the first insert.

* * * * *